US006402575B1

(12) United States Patent
Suzuki

(10) Patent No.: US 6,402,575 B1
(45) Date of Patent: Jun. 11, 2002

(54) TAB OF TERMINAL FITTING

(75) Inventor: Kenji Suzuki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/947,541

(22) Filed: Sep. 7, 2001

(30) Foreign Application Priority Data

Sep. 8, 2000 (JP) ..... 2000-273292

(51) Int. Cl.[7] ..... H01R 4/18
(52) U.S. Cl. ..... 439/884; 439/866
(58) Field of Search ..... 39/884, 825, 866, 39/883, 885, 889, 868

(56) References Cited

U.S. PATENT DOCUMENTS 4,764,133 A * 8/1988 Kaneko ..... 439/889
5,649,842 A * 7/1997 Ohsumi ..... 439/858
5,664,974 A * 9/1997 Endo et al. ..... 439/884
5,681,192 A * 10/1997 Kobayashi et al. ..... 439/884
5,692,928 A * 12/1997 Nelson et al. ..... 439/733.1
5,795,197 A * 8/1998 Tsuji et al. ..... 439/884
5,989,080 A * 11/1999 Tsuji et al. ..... 439/884
6,238,252 B1 * 5/2001 Flieger ..... 439/746

* cited by examiner

*Primary Examiner*—Tulsidas Patel
(74) *Attorney, Agent, or Firm*—Sughrue Mion, PLLC

(57) ABSTRACT

A tab (2) constitutes a male terminal (1) serving as a terminal fitting. The tab (2) is inserted into a cylindrical electric contact portion (6) of a female terminal (3) serving as a mating terminal fitting. The tab (2) is sandwiched by a pair of resilient pieces (7) of the electric contact portion 6 of the female terminal (3). This prevents the tab (2) from going out of the electric contact portion (6). The tab (2) is formed by bending a sheet metal. The sheet metal is formed so that the thickness of a part (23) thereof, which includes portions to be respectively brought into contact with the resilient pieces (7) when the tab (2) is inserted into the electric contact portion (6), is smaller than those of other parts thereof. Curved surfaces (31) respectively placed on the corners of the part (23) are formed so that the radius of curvature of each of the curved surfaces (31) is small. Even when the tab (2) is misaligned, a flat surface (35) placed between the curved surfaces (31) comes in contact with the resilient pieces (7), respectively.

7 Claims, 6 Drawing Sheets

TAB OF TERMINAL FITTING

BACKGROUND OF THE INVENTION

The present invention relates to a tab of a terminal fitting, which is inserted into an electric contact portion of a female terminal fitting, for connecting an electric wire to the female terminal fitting.

Generally, as shown in FIGS. 6A to 7B, tabs 102*a* and 102*b* of male terminal fittings (hereunder referred to simply as male terminals) to be inserted into female terminal fittings serving as mating terminal fittings are formed by bending electrically conductive sheet metals. Thus, as illustrated in FIGS. 6A to 7B, curved surfaces 131*a* and 131*b* each having a radius of curvature, which is nearly equal to the thickness of the sheet metal 120, are formed on side portions of the tabs 102*a* and 102*b*.

Meanwhile, for example, when a tab 120*c*, which has a structure similar to that shown in FIGS. 7A and 7B and is 0.64 mm thick and 0.6 mm wide, is formed, the radius of curvature of the curved surface 131*c* placed at each of corners thereof becomes large, as illustrated in FIG. 8. Moreover, flat surfaces 135*c*, each of which is placed between the corresponding curved surfaces 131*c*, become narrow.

Further, when the tab 102*c* is inserted into a cylindrical electric contact portion 106 of the female terminal 103 as shown in FIG. 9A, contact portions 107*a* of a pair of resilient pieces 107 of the female terminal 103 come into contact with the flat surfaces 135*c*, respectively. The pair of resilient pieces 107 generates an elastic restoring force acting in a direction in which the tab 102 is sandwiched therebetween. The tab 102*c* is restrained from going out of the electric contact portion 106.

In the case that the tab 102*c* is misaligned with respect to the contact portions 107*a* in the electric contact portion 106 at that time, as illustrated in FIG. 9B, the contact portions 107*a* may face the curved surfaces 131*c* in such a way as to come into contact therewith. In this case, the elastic restoring force of each of the resilient pieces 107 becomes weak, so that the tab 102*c* easily goes out of the electric contact portion 106 of the female terminal 103.

SUMMARY OF THE INVENTION

Accordingly, an object of the invention is to provide a tab of a terminal fitting, which can be prevented from going out of an electric contact portion of a mating terminal fitting.

To eliminate the drawback of the conventional tab and achieve the foregoing object, according to the invention, there is provided a terminal fitting tab (hereunder referred to as a first tab), which is adapted to be inserted into a cylindrical electric contact portion of a mating terminal fitting and to be urged by resilient pieces of the counterpart terminal fitting thereby to be restrained from going out of the electric contact portion. This tab is formed by bending an electrically conductive metal sheet. The metal sheet comprises a part including portions, which are brought into contact with the resilient pieces when the tab is inserted into the electric contact portion, and the remaining parts. In the case of this tab, the metal sheet is formed so that the thickness of the part including the portions to be brought into contact with the resilient pieces is less than the thickness of the remaining parts.

According to an embodiment (hereunder referred to as a second tab) of the first tab of the invention, the metal sheet is formed so that the part including the portions to be brought into contact with the resilient pieces has a concave portion formed by denting one surface thereof, and that the other surface placed in back of the one surface of the part including the portions to be brought into contact with the resilient pieces is formed in such a manner as to be flush with corresponding surfaces of the remaining parts.

According to an embodiment (hereunder referred to as a third tab) of the second tab of the invention, the tab is formed by bending the metal sheet so that the one surface of the part including the portions to be brought into contact with the resilient pieces is inwardly placed, and that the other surface thereof is outwardly placed.

According to the first tab of the invention, the metal sheet to be bent in such a way as to constitute the tab is formed so that the thickness of the part including the portions to be brought into contact with the resilient pieces is less than the thickness of the remaining parts. Thus, when the tab is formed by bending the metal sheet, the radius of curvature of each of curved surfaces formed on corners of the part including such portions is small.

According to the second tab of the invention, the part including the portions to be brought into contact with the resilient pieces has a concave portion formed by denting one surface thereof. Moreover, the other surface placed in the back of the one surface of the part including such portions is formed in such a manner as to be flush with corresponding surfaces of the remaining parts. Thus, the part including the portions to be brought into contact with the resilient pieces is reliably formed in such a way as to have a thickness that is less than the thicknesses of the remaining parts.

According to the third tab of the invention, the metal sheet is bent so that the one surface of the part including the portions to be brought into contact with the resilient pieces is inwardly placed, and that the other surface thereof is outwardly placed. Thus, the radius of curvature of each of curved surfaces formed on corners of the part including such portions is small. In addition, portions of such a part, which respectively face the resilient pieces, are formed in such a manner as to be flush with corresponding surfaces of the remaining parts. This facilitates the contact between such portions and the resilient pieces.

DETAILED DESCRIPTION OF PREFERRED EMBODIMENT

Figure 1:
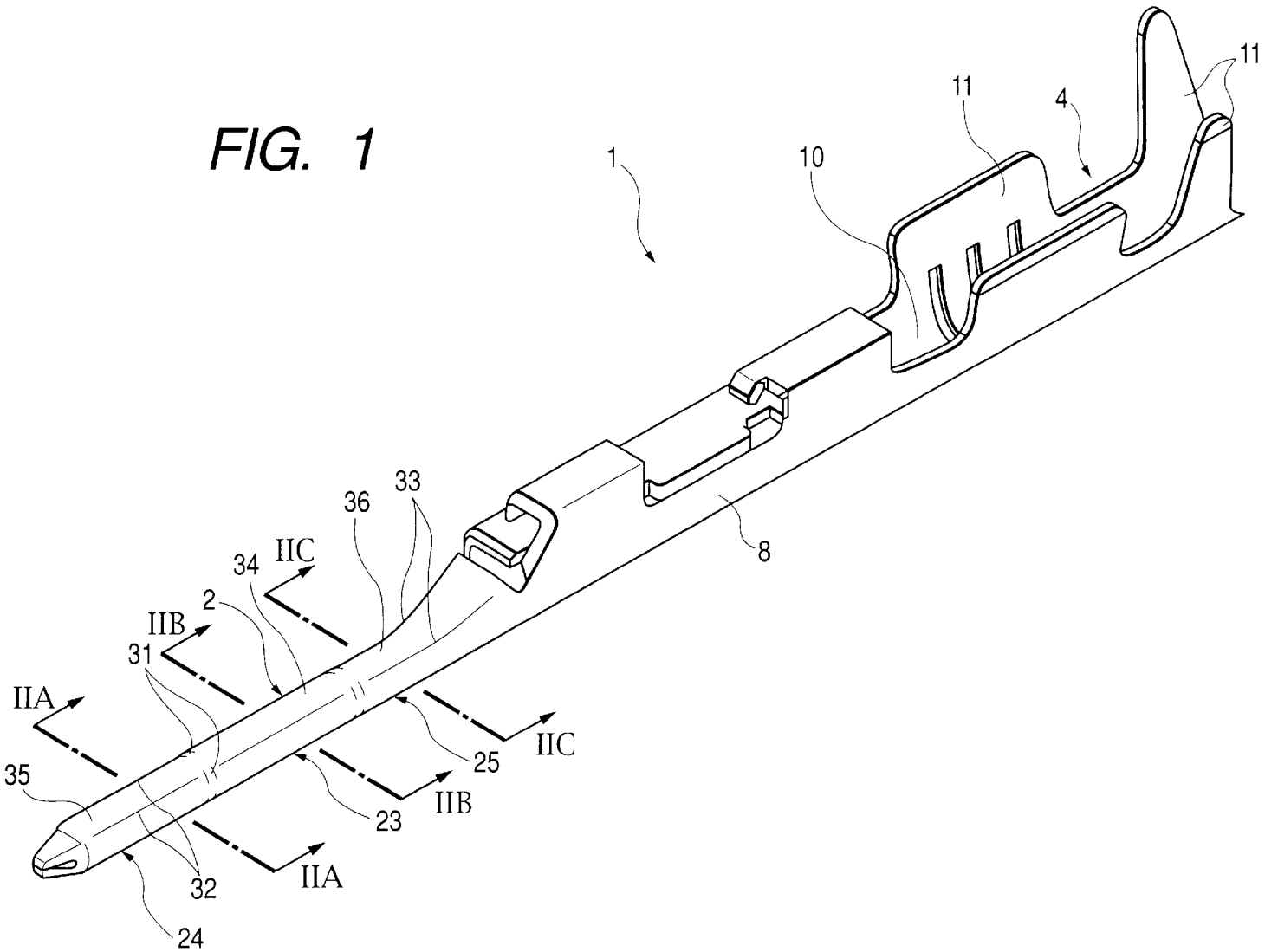
FIG. 1 is a perspective view illustrating a male terminal having a tab, which is an embodiment of the invention.

Hereinafter, a tab 2 according to an embodiment of the invention, and a male terminal fitting (hereunder referred to simply as a male terminal) 1 serving as a terminal fitting, which has the tab 2, are described by referring to FIGS. 1 to 5B. The male terminal 1 having the tab 2 shown in FIG. 1 is used for electrically connecting a female terminal fitting (hereunder referred to as a female terminal) 3, serving as a mating terminal fitting, to an electric wire (not shown).

Figure 5A:
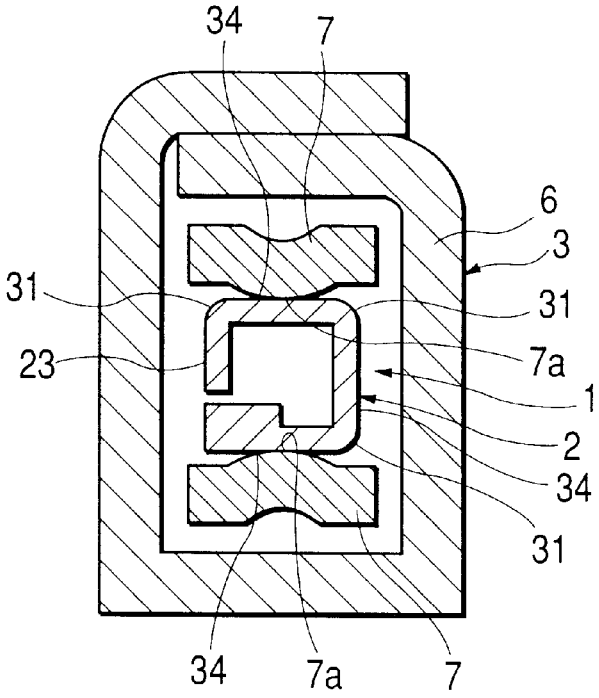
FIG. 5A is a sectional view illustrating a manner in which the tab, that is, this embodiment is inserted into an electric contact portion of a female terminal.
Figure 5B:
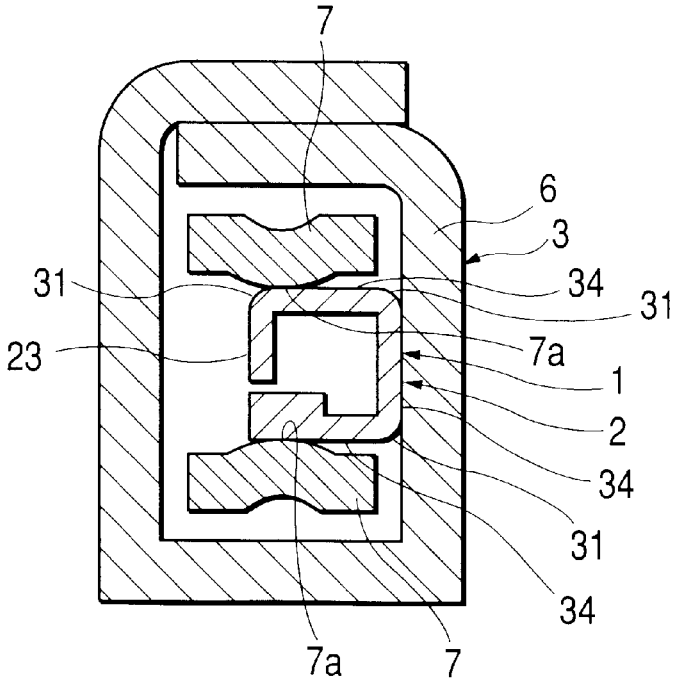
FIG. 5B is a sectional view illustrating a manner in which the tab is moved from the position thereof shown in FIG. 5A.
Figure 6A:
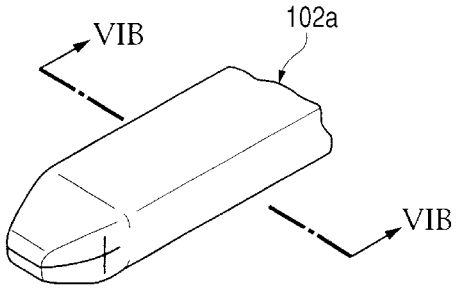
PRIOR ART FIG. 6A
FIG. 6A is a perspective view illustrating an example of a related tab.
Figure 6B:
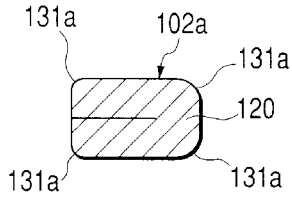
FIG. 6B PRIOR ART
FIG. 6B is a sectional view taken along line VIB—VIB of FIG. 6A.
Figure 7A:
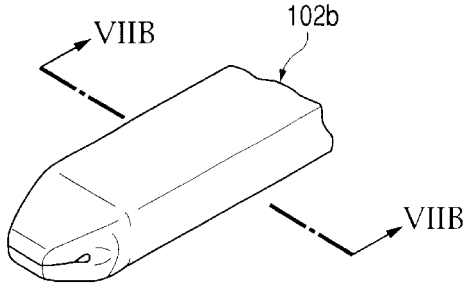
PRIOR ART FIG. 7A
FIG. 7A is a perspective view illustrating another example of the related tab.
Figure 7B:
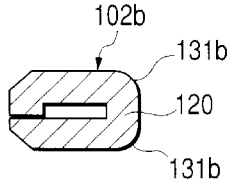
FIG. 7B PRIOR ART
FIG. 7B is a sectional view taken along line VIIB—VIIB of FIG. 7A.
Figure 8:
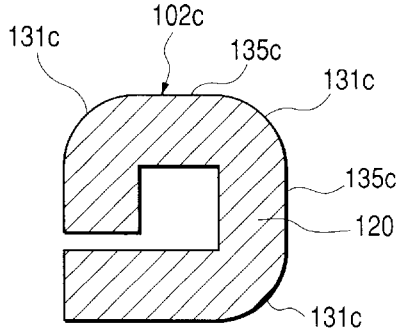
PRIOR ART FIG. 8
FIG. 8 is a sectional view illustrating another example of the related tab.
Figure 9A:
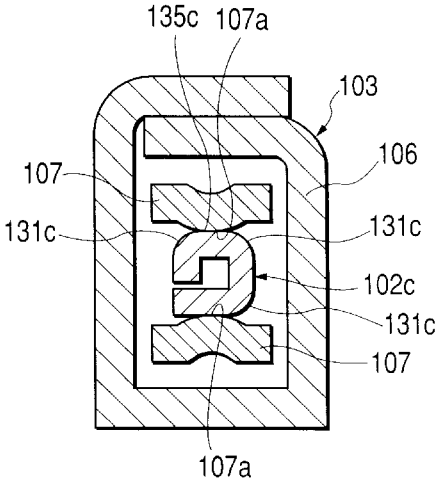
PRIOR ART FIG. 9A
FIG. 9A is a sectional view illustrating a manner in which the tab shown in FIG. 8 is inserted into an electric contact portion of the female terminal.
Figure 9B:
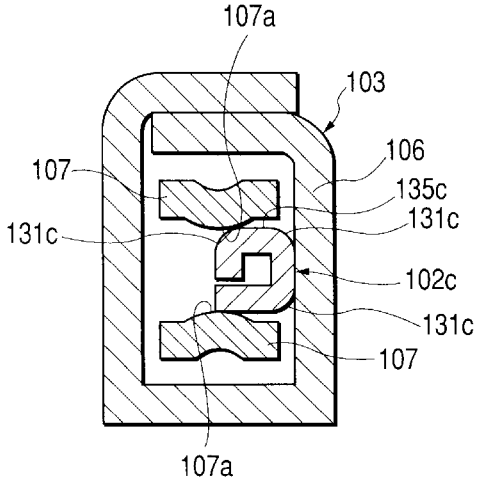
FIG. 9B PRIOR ART
FIG. 9B is a sectional view illustrating a manner in which the tab is moved from the position thereof shown in FIG. 9A.

The female terminal 3 is formed from an electrically conductive metal sheet, and has an electric wire connecting portion (not shown) and an electric contact portion 6 shown in FIGS. 5A and 5B, which are formed in such a manner as to be integral with each other. The electric wire connecting portion is electrically connected and fixed to the electric wire by crimping an electric wire and cutting a sheath portion. The electric contact portion 6 is formed in such a manner as to be cylindrical, as illustrated in FIGS. 5A and 5B. Moreover, the electric contact portion 6 has a pair of resilient pieces 7 that face each other.

The resilient pieces 7 are capable of elastically deforming in a direction in which these pieces 7 approach each other and separate from each other. Each of the resilient pieces 7 has a contact part 7*a* provided at a central portion in the direction of width thereof. These contact parts 7*a* inwardly project from other portions of the resilient pieces 7 in the electric contact portion 6.

When the tab 2 of the male terminal 1 is inserted into the electric contact portion 6, the tab 2 is sandwiched between the pair of resilient pieces 7 in the female terminal 3. Incidentally, at that time, the pair of resilient pieces 7 generates an elastic restoring force for urging the tab 2 in a direction in which the tab 2 is sandwiched therebetween. Thus, the tab 2 is restrained from going out of the electric contact portion 6.

Figure 3:
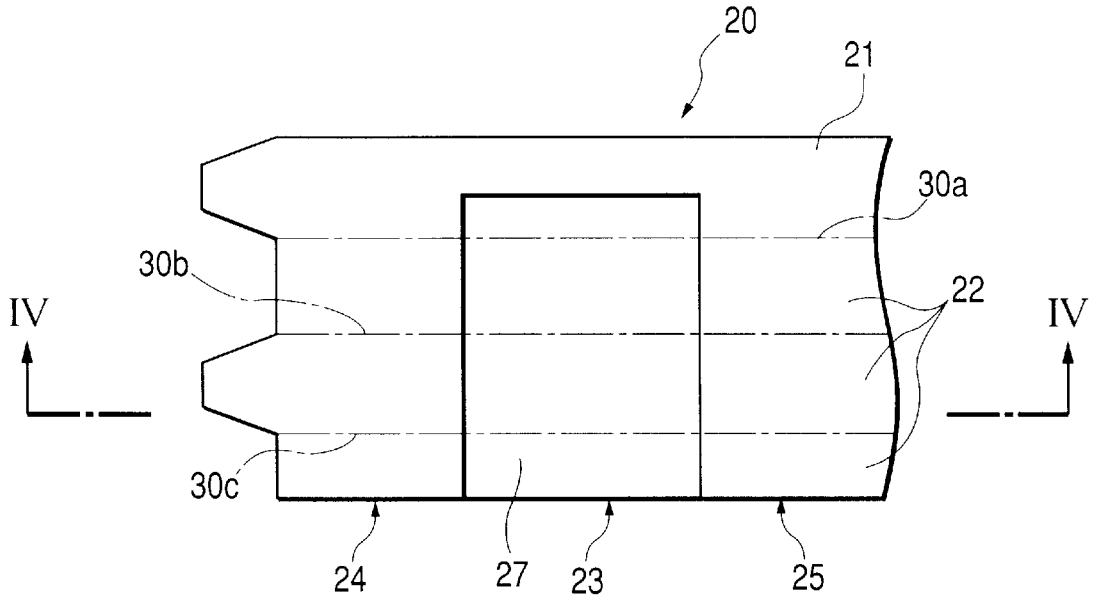
FIG. 3 is a plan view illustrating a sheet metal from which the tab, that is, this embodiment is formed.
Figure 4:
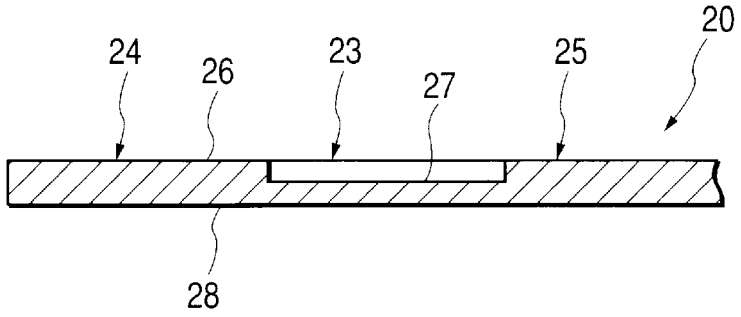
FIG. 4 is a sectional view taken along line IV—IV of FIG. 3.

The male terminal 1 is formed by bending an electrically conductive metal sheet 20 (incidentally, FIGS. 3 and 4 show a part, which corresponds to the tab 2 of the metal sheet 20). As shown in FIG. 1, the male terminal 1 has an electric wire connecting portion 4, to which the electric wire is electrically connected, and also has a tube portion 8, and the tab 2 to be inserted into the electric contact portion 6. These portions 4 and 8 and the tab 2 are integrally formed. In this male terminal 1, the electric wire connecting portion 4, the tube portion 8 and the tab 2 are aligned in this order.

The electric wire connecting portion 4 is connected to the tube portion 8 and has a bottom wall 10 and a plurality of caulking pieces 11 aligned along an edge of this bottom wall 10. The bottom wall 10 is formed flat. Further, the shape in the horizontal plane of the bottom wall 10 is formed in rectangular. An end portion of the electric wire, whose core is exposed, is put on the bottom wall 10. The caulking pieces 11 are aligned along each of the edges respectively placed at both ends in the direction of width of the bottom wall 10.

The end portion of the electric wire in which the core is exposed is put on the bottom wall 10, and the caulking pieces 11 is bend in a direction in which an end portion of this electric wire is urged against the bottom wall 10, so that the electric wire connecting portion 4 is electrically connected. That is, the connecting portion 4 is electrically connected to the wire by caulking the wire by using the caulking pieces 11.

The tube portion 8 is connected to both the electric wire connecting portion 4 and the tab 2, and formed like a quadrangular prism. When the male terminal 1 is inserted into a connector housing, the tube portion 8 is inserted into a terminal accommodating chamber of this connector housing. The tube portion 8 is held in intimate contact with the inner wall surface of the terminal accommodating chamber to thereby prevent the male terminal 1 from being misaligned in the connector housing. Moreover, a latching arm etc. of the connector housing is latched onto the tube portion 8. When the latching arm is latched onto the tube portion 8, the male terminal 1 is prevented from going out of the terminal accommodating chamber.

The tab 2 is connected to the tube portion 8 and formed like a cylinder and has a flat bottom wall 12 nearly flush with the bottom wall 10, and a plurality of peripheral walls 13, which are connected to or face the bottom wall 12. The tab 2 is formed in such a way as to be thinner than the tube portion 8. Each of the bottom wall 12 and the peripheral walls 13 is formed like a band. Further, the tab 2 is formed so that a tip end portion thereof, which is placed apart from the electric wire connecting portion 4, is gradually tapered off toward the tip end thereof.

The electrically conductive metal sheet 20 shown in FIGS. 3 and 4, from which the male connector 1 of the aforementioned configuration is produced, is obtained by punching an electrically conductive metal plate made of copper or a copper alloy (including brass and beryllium copper).

The part, which corresponds to the tab 2, of the metal sheet 20 is formed like a flat plate whose horizontal plane is nearly rectangular, as shown in FIG. 3. Further, the metal sheet 20 has a bottom wall correspondent portion 2l corresponding to the bottom wall 12, and also has a plurality of peripheral wall correspondent portions 22 corresponding to the peripheral walls 13, as illustrated in FIG. 3. Each of the bottom wall correspondent portion 21 and the peripheral wall correspondent portions 22 is formed like a band. The tab 2 is formed by bending the metal sheet along bending lines 30*a*, 30*b*, and 30*c*, which are drawn on boundaries of adjacent ones of the bottom wall correspondent portion 21 and the peripheral wall correspondent portions 22 and indicated by chain lines in FIG. 3.

The metal sheet 20 is formed so that the thickness of a part 23 thereof including portions to be respectively brought into in contact with the resilient pieces 7 when the tab 2 is inserted into the electric contact portion 6 of the female terminal 3 is smaller than those of the remaining parts 24 and 25 thereof. As shown in FIG. 4, a concave portion 27 is formed in the part 23 by recessing one surface 26 of the metal sheet 20. As illustrated in FIG. 3, the concave portion 27 is formed all over the peripheral wall correspondent portions 22 along the direction of width of the metal sheet 20 in such a way as to extend from the centerline in the direction of width of the bottom wall correspondent portion 21.

The other surface 28 placed in the back of the one surface 26 of the metal sheet 20 is formed so that parts of the surface 28, which respectively correspond to the parts 23, 24, and 25, are flush with one another. In the case of the embodiment illustrated in this figure, the remaining parts 24 and 25 include a divisional portion 24, which is located apart from the electric wire connecting portion 4 and at the frontward side of the one part 23, and another divisional portion 25 located closer to the electric connecting portion 4 and at a base end side.

The tab 2 is formed by bending the metal sheet 20 along the bending lines 30*a*, 30*b*, and 30*c* so that the one surface 26 is inwardly placed, and that the other surface 28 is outwardly placed. Thus, the radius of curvature of each of curved surfaces 31 formed on corners of the part 23 shown in FIG. 2B is less than that of curvature of each of curved surfaces 32 and 33 formed on corners of the parts 24 and 25 respectively shown in FIGS. 2A and 2C.

Figure 2A:
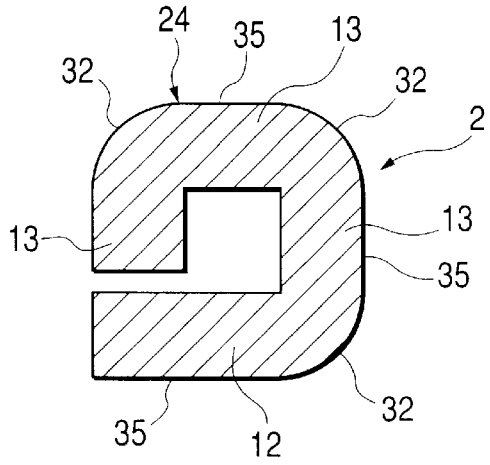
FIG. 2A is a sectional view taken along line IIA—IIA of FIG. 1.
Figure 2B:
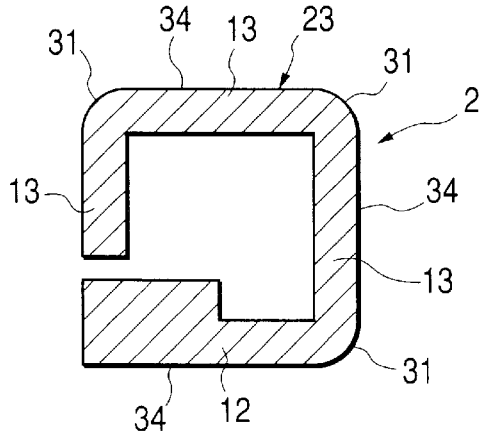
FIG. 2B is a sectional view taken along line IIB—IIB of FIG. 1.
Figure 2C:
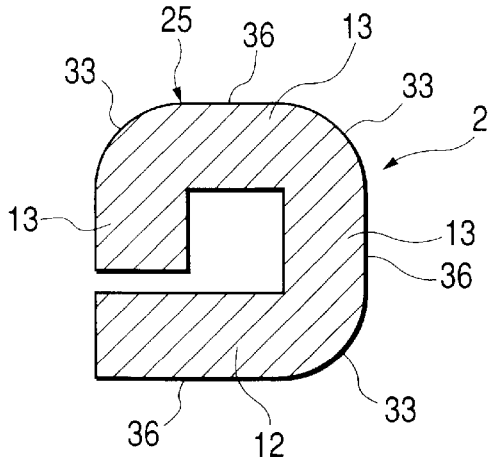
FIG. 2C is a sectional view taken along line IIC—IIC of FIG. 1.

Furthermore, the tab 2 is formed so that the area of each of flat surfaces 34 extending between the corners of the part 23 shown in FIG. 2B is larger than that of each of flat surfaces 35 and 36 extending between the corners of the parts 24 and 25 respectively shown in FIGS. 2A and 2C.

According to this embodiment, the one part 23 is formed in such a manner as to be thinner than the remaining parts 24 and 25. Moreover, the concave portion 27 is formed by denting the one surface 26. Furthermore, the other surface 28 is formed so that the parts of the surface 28 are flush with one another. Besides, the tab 2 is formed by bending the metal sheet 20 so that the one surface 26 is inwardly placed, and that the other surface 28 is outwardly placed. Additionally, the radius of curvature of each of curved surfaces 31 formed on the corners of the part 23 is small.

Thus, even in the case that a misalignment between the tab 2 and a pair of the resilient pieces 7 is caused when the tab 2 is inserted into the electric contact portion 6 of the female terminal 3, the contact parts 7*a* of the resilient pieces 7 are prevented from coming into contact with the curved surfaces 31. Consequently, the elastic restoring force for urging the tab 2 in a direction in which the tab 2 is sandwiched between the resilient pieces 7 is prevented from being weakened. Thus, the tab 2 is reliably prevented from going out of the electric contact portion 6 of the female terminal 3.

As described above, according to the present invention, when the tab is formed by bending the metal sheet, the radius of curvature of each of curved surfaces formed on the corners of the part including the portions to be brought into contact with the resilient pieces is small. Thus, the area of flat surfaces of such a part increases. Further, even in the case that a misalignment between the tab and a pair of the resilient pieces is caused when the tab is inserted into the electric contact portion of the mating terminal fitting, the resilient pieces of the mating terminal fitting are prevented from coming into contact with the curved surfaces. Moreover, each of the flat surfaces makes reliable contact with a corresponding one of the resilient pieces.

Therefore, even when the tab is misaligned in the electric contact portion of the mating terminal, the urging force of the resilient pieces of the mating terminal fitting is not reduced. Thus, the tab is prevented from going out of the electric contact portion of the mating terminal fitting.

Further, according to the invention, the part including the portions to be brought into contact with the resilient pieces has a concave portion formed by denting one surface thereof. Moreover, the other surface is formed in such a manner as to be flush with corresponding surfaces of the remaining parts. Thus, the part including the portions to be brought into contact with the resilient pieces is reliably formed in such a way as to have a thickness that is less than the thickness of the remaining parts. Consequently, the radius of curvature of each of the curved surfaces formed on corners of the part including such portions is reliably made to be small. Thus, the area of flat surfaces of such a part reliably increases. Further, the tab is reliably prevented from going out of the electric contact portion of the mating terminal fitting.

According to the third tab of the invention, the metal sheet is bent so that the one surface of the part including the portions to be brought into contact with the resilient pieces is inwardly placed, and that the other surface thereof is outwardly placed. Thus, the radius of curvature of each of curved surfaces formed on corners of the part including such portions is small. In addition, portions of such a part, which respectively face the resilient pieces, are formed in such a manner as to be flush with corresponding surfaces of the remaining parts. This facilitates the contact between such portions and the resilient pieces. Therefore, even when the tab is misaligned in the electric contact portion of the mating terminal, the urging force of the resilient pieces of the mating terminal fitting is more reliably prevented from being reduced. Thus, the tab is more reliably prevented from going out of the electric contact portion of the mating terminal fitting.

What is claimed is:

1. A tab formed in a terminal fitting, wherein the tab is adapted to be inserted into a cylindrical electric contact portion of a mating terminal fitting, wherein the tab is urged by resilient pieces of the mating terminal fitting to be restrained from going out of the electric contact portion when the tab is inserted into the electric contact portion, wherein the tab is formed by bending an electrically conductive metal sheet into a rectangular shape, wherein the electrically conductive metal sheet comprises a first part including portions to be brought into contact with the resilient pieces when the tab is inserted into the electric contact portion, and a remaining second part, which is longitudinally offset from the first part, and wherein the thickness of the electrically conductive metal sheet at the first part is smaller than the thickness of the electrically conductive metal sheet at the second part, such that corner portions of said first part have a smaller radius of curvature than corner portions of said second part.

2. The tab according to claim 1, wherein the electrically conductive metal sheet is formed so that the first part has a concave portion formed by recessing one surface thereof and the other surface placed in back of the one surface thereof including the first and second part is flat.

3. The tab according to claim 2, wherein the tab is formed by bending the electrically conductive metal sheet so that the one surface thereof is inwardly placed, and that the other surface thereof is outwardly placed.

4. A terminal fitting, comprising:

an electric wire connecting portion adapted to be connected to a wire;

a tube portion connected to and integrally formed with the electric wire connecting portion; and a tab adapted to be inserted into an electric contact portion of a mating terminal fitting and connected to and integrally formed with the tube portion, wherein the tab is formed by a metal sheet, which is bent into a rectangular shape and which includes at least a first section and a second section that is longitudinally offset from the first section, and wherein the thickness of the metal sheet at the first section is smaller than the thickness of the metal sheet at the second section, such that corner portions of said first section have a smaller radius of curvature than corner portions of said second section.

5. The terminal fitting according to claim 4, wherein the electric wire connecting portion, the tube portion and the tab are integrally formed by the metal sheet.

6. The terminal fitting according to claim 5, wherein the metal sheet includes the first section forming a part of the tab and the second section forming the electric wire connecting portion, the tube portion and a remaining part of the tab, and wherein the first section is thinner than the second section.

7. An electrical connector arrangement, comprising:

a first terminal comprising:

a first part having first walls of a first thickness; and a second part having second walls of a second thickness; and a second terminal having an electrically conducting contact portion;

wherein the first terminal is structured to be inserted into the second terminal such that the first part of the first terminal engages with the electrically conducting contact portion of the second terminal; and wherein a surface of the first walls that faces an inside of the first part comprises a recess such that the first thickness of the first walls is less than the second thickness of the second walls.

* * * * *